US005839627A

United States Patent [19]

Hicks et al.

[11] Patent Number: 5,839,627

[45] Date of Patent: Nov. 24, 1998

[54] CONTAINER HAVING IMPROVED RECLOSABLE POUR SPOUT MOUNTED THEREON AND PROCESS THEREFOR

[76] Inventors: William D. Hicks, 5 Parkview Ave., Queensbury, N.Y. 12804; William J. Shea, Jr., 23 Pineknoll Rd., Lenox, Mass. 01240

[21] Appl. No.: 807,102

[22] Filed: Feb. 3, 1997

Related U.S. Application Data

[63] Continuation of Ser. No. 355,124, Nov. 7, 1994, abandoned.

[51] Int. Cl.[6] ..... B65D 47/10

[52] U.S. Cl. ..... 222/541.9

[58] Field of Search ..... 222/541.6, 541.9, 222/545, 562; 215/255; 220/269, 258

[56] References Cited

U.S. PATENT DOCUMENTS

| | | | |
|---|---|---|---|
| 3,495,746 | 2/1970 | Laurizio | 222/541.9 |
| 3,610,484 | 10/1971 | Matzka | 222/541.9 |
| 3,770,185 | 11/1973 | Reeves . | |
| 4,274,563 | 6/1981 | Otterson . | |
| 4,429,828 | 2/1984 | Färber . | |
| 4,498,588 | 2/1985 | Scott . | |
| 4,562,936 | 1/1986 | Deflander . | |
| 4,770,325 | 9/1988 | Gordon et al. . | |
| 4,798,295 | 1/1989 | Rausing . | |
| 4,887,765 | 12/1989 | Rausing . | |
| 4,948,015 | 8/1990 | Kawajiri et al. | 222/541.9 |
| 4,986,465 | 1/1991 | Jacobsson et al. . | |
| 5,027,979 | 7/1991 | Kawajiri et al. . | |
| 5,065,938 | 11/1991 | Anderson . | |
| 5,069,372 | 12/1991 | Kawajiri . | |
| 5,080,233 | 1/1992 | Wyberg . | |
| 5,088,643 | 2/1992 | Frazier et al. . | |
| 5,101,999 | 4/1992 | Robichaud et al. . | |
| 5,108,209 | 4/1992 | Abrams et al. . | |
| 5,141,133 | 8/1992 | Ninomiya et al. . | |
| 5,174,465 | 12/1992 | Luch et al. . | |
| 5,199,618 | 4/1993 | Reil et al. | 222/541.9 |
| 5,199,635 | 4/1993 | Abrames et al. . | |
| 5,249,695 | 10/1993 | Luch et al. . | |
| 5,271,519 | 12/1993 | Adams et al. . | |
| 5,297,969 | 3/1994 | Berstein et al. | 222/83 |
| 5,301,849 | 4/1994 | Guglielmini et al. | 222/541.9 |
| 5,303,837 | 4/1994 | Adams et al. . | |
| 5,325,983 | 7/1994 | Imai et al. . | |
| 5,348,182 | 9/1994 | Luch . | |
| 5,348,183 | 9/1994 | Luch et al. . | |
| 5,348,184 | 9/1994 | Adams et al. . | |
| 5,364,019 | 11/1994 | Björck et al. . | |

FOREIGN PATENT DOCUMENTS

| | | | |
|---|---|---|---|
| 279486 | 8/1988 | European Pat. Off. . | |
| 1523236 | 5/1968 | France | 222/541.9 |
| 4409945 A1 | 9/1995 | Germany . | |
| 40-1009170 | 1/1989 | Japan | 222/541.9 |
| 1455797 | 11/1976 | United Kingdom . | |
| 2210359 | 6/1989 | United Kingdom . | |
| 2233315 | 1/1991 | United Kingdom | 222/541.9 |

*Primary Examiner*—Philippe Derakshani
*Attorney, Agent, or Firm*—Wolf, Greenfield & Sacks, P.C.

[57] ABSTRACT

A reclosable pour spout for containers which have been filled with a liquid is mounted on the container without the necessity of making an opening in the container to hold the spout or obtain access to the contents of the container. The spout acts to preserve the integrity of the liquid contents of the container. The reclosable pour spout has an inner membrane seal formed in the bottom of the pour spout. The bottom surface of the membrane seal is attached to the container. The container may have a scored portion in the area of the membrane seal to allow the scored portion of the container to become firmly attached to the membrane seal and come out of the container with the membrane seal when the membrane seal is removed from the spout to gain access to the liquid contents of the container.

30 Claims, 14 Drawing Sheets

CONTAINER HAVING IMPROVED RECLOSABLE POUR SPOUT MOUNTED THEREON AND PROCESS THEREFOR

This application is a continuation-in-part of application Ser. No. 08/355,124, filed Nov. 7, 1994 now abandoned.

FIELD OF THE INVENTION

The present invention pertains to a pour spout and more particularly to a container having an improved reclosable pour spout attached thereto.

BACKGROUND OF THE INVENTION

There are various types of spouts which have been proposed for attachment to containers to facilitate the emptying of the contents from the container. For example, U.S. Pat. No. 5,199,635 issued Apr. 6, 1993 for "A CONTAINER HAVING A RECLOSABLE POUR SPOUT MOUNTED THEREON", assigned to the assignee of the present invention, discloses a container for holding pourable contents and includes a pour spout having a flange member with oppositely positioned first and second sides. The container includes an opening formed in the wall thereof, into which is mounted the pour spout by inserting the stem into the opening in the container wall. The portion of the pour spout which extends through the container opening on the surface opposite to the pouring surface is bent upwards so as to secure the spout in the aperture or opening. Similarly, in U.S. Pat. No. 5,108,029 issued Apr. 28, 1992 entitled "ENCLOSABLE ATTACHMENT FOR CONTAINERS", also assigned to the assignee of the present invention, discloses a reclosable attachment for containers in which a spout is attached to a flange member. The flange member is then assembled onto a gable top or other surface of a container through an opening which has been formed in the container such that the pour spout and opening are axially aligned. The pour spout is attached to the container by a combination of heat and pressure to firmly secure the flange and spout to the container. It is also known in the art, in lieu of applying heat and pressure to "melt" the container to the pour spout flange, to use glue such as hot melt glue or other suitable adhesive. While the containers and pour spouts described in above patents are satisfactory in a number of applications in which an opening has been already formed in the container, each of the pour spouts described in the above patents requires, in order for them to function properly, that an opening be formed in the container prior to attachment of the pour spout. In certain types of liquids and granular solids, the seal formed by the pour spout is sufficient to maintain the integrity of the product within the container. However, as packaging of materials which are subject to spoilage becomes more popular, an opening in the container, even if covered, may compromise the integrity of the contents within the container. Aseptic packaging today has become an evermore popular method of containing liquid products such as milk which is subject to spoilage. In some aseptic packaging applications the container may be made of a metal (such as aluminum sheet material) or a polyethylene or other plastic sheet material which is cleaned and sterilized prior to the filling of the container with a liquid in sterile conditions. One advantage of aseptic packaging is that meeting the liquid within the container may have a much longer shelf life than otherwise. The problem is that in order to maintain such integrity, it is desirable that the entire contents of the container be sealed within the sheet of metal or polyethylene materials. It is known in the prior art to provide an innermost layer membrane seal in certain types of containers for liquids such as household oils. These seals incorporate an inner membrane which must be torn out and removed prior to use by the consumer. The purpose of these tear out inner membranes is to prevent the leakage of liquid contained within the container as well as to maintain product integrity. With these prior art resealable membranes, however, each requires that an opening already had been formed within the container and thus these devices do not solve the problem discussed above, that of maintaining product integrity of certain products which require that the liquid be entirely surrounded by a sealed metal or plastic liner.

Packaging such as the popular "juice pack" container, used to hold fruit and other juices, seal the liquid contained within the container within an aluminum or other metal or plastic inner liner. When it is desired to open juice pack containers, a straw with an angled end pierces the exposed inner foil or plastic lining of the juice pack to allow the liquid contained therein to be removed. Similarly in other aseptic packaging environments, pour spouts have been attached to a surface of the aesthetic package or "brick pack". However, upon initial use, the user is required to lift the pour spout and to pierce the inner lining so that the contents may be removed. While the piercing of both juice packs and brick packs is a way to break the seal of an aseptic or other container, they have the disadvantage of having to pierce with a sharp object which may cause spilling or even harm to the person who is piercing the membrane or other film exposed within the pour spout.

SUMMARY OF THE INVENTION

To address the foregoing disadvantages and improve upon the function and operation of containers having pour spouts, the present invention provides a container having an improved pour spout mechanism which maintains the integrity of the liquid or granular solids contained within the container until such time as a user desires to open the container and pour out the contents. In accordance with one aspect of the present invention, the pour spout includes an inner membrane seal integrally but remotely formed on the bottom surface of the pour spout, that is the surface of pour spout which is in contact with the container to which it is attached.

The inner main membrane seal is attached to the pour spout as will be detailed below but may be removable from the pour spout. Thus, the attachment of the inner membrane seal to the pour spout is made to be frangible. That is, with a certain amount of force, it may be moved relative to the pour spout. In order to maintain the integrity of the package, unlike the prior art patents discussed above, the entire assemblage of the pour spout and the inner membrane seal attached thereto is attached to a surface of the container by any number of methods including the combination of heat and pressure and/or adhesives such as hot melt glues. Thus, by not breaking the container inner lining, there is no compromise of the integrity of the container.

The improved pour spout with membrane seal may be attached to the container either after the container has been formed and filled with the desired liquid or may be attached prior to the forming and introduction of the liquid into the container. When the pour spout with the inner membrane seal is attached to the container, the inner membrane seal has a bottom surface which is in contact with the exterior surface of the liquid container itself. The inner membrane seal forms a firm bond with the portion of the container to which it is attached. In one embodiment, the container is scored on its exterior surface, that is, the surface which is in contact with the bottom surface of the inner membrane seal. As will be discussed in more detail below, the user may expose the contents of the container by grabbing a tab or other gripping device attached to the membrane seal and pulling upwardly. The upward pressure on the membrane seal forces the membrane seal to break away from the pour spout to which it is partially attached, while the pour spout remains attached to the container. At the same time, the container material below the inner membrane seal will also break away with the inner membrane seal, thus exposing the contents of the package to be poured through the pour spout of the present invention.

In another aspect of the present invention, if the container is sufficiently thin, it may not be necessary to score the container in that area in which the inner membrane seal is attached.

In yet another aspect of the present invention, instead of scoring the outward portion of the container, the outermost layer or layers may be cut away from the container leaving only the inner metal or plastic or other material forming the liner to maintain the integrity of the product contained within the container. The assembly of the pour spout with the inner membrane seal will provide whatever insulative or other protective functions were previously provided by the outermost layer or layers on the container.

In yet another aspect of the invention, instead of pulling the inner membrane seal out of the mouth of the pour spout, it may first may first be pushed into the container when suitable, so as to break through the inner liner of the container and then pulled out.

In yet another aspect, when suitable, that is, when the liquid present within the container does not fill up the entire container, the inner membrane seal may simply be pushed through into the container, thus opening the container to provide access to the liquid or solids.

Still another aspect of the present invention is an improved process of mounting the pour spout with its inner membrane seal on a container which has already been filled. In certain types of container materials, the spout may be assembled on the container by heating either or both of the pour spout and the container, the combination of heat and pressure adhering the container and spout to each other. Even in this mode of attaching the spout to the container, it may be desirable to make the adhesion of the inner membrane seal to the scored or unscored portion of the container below the spout even stronger, in which event an amount of adhesive such as hot melt glue may be, during the process of assembly, spread on the bottom portion of the inner membrane seal. It is important that the inner membrane seal, and the portion of the container to which it is attached, become strongly adhesively connected to insure that that portion of the container underlying the seal is removed with removal of the inner membrane seal.

It yet another aspect of the present invention, instead of using a combination of heat and pressure to assemble the pour spout with attached inner membrane seal to the container, the entire spout may be glued by suitable adhesive such as hot melt glue to the container either prior to or after the introduction of liquid into the container. The cap attached to the pour spout may be either of the variety of a screw top or a short turn, such as a one quarter turn closure, a long thread screw or a snap top as will be described in detail below. The reclosable pour spout of the present invention is especially suitable for aseptic or other types of containers in which integrity of the contained liquid is important, although the improved spout of the present invention may be used with any type of container in which spouts may be attached.

BRIEF DESCRIPTION OF THE DRAWING FIGURES

FIG. 1(*b*) is a cross sectional side view of another embodiment of the reclosable pour spout in a membrane seal having snap-type cap closure.

FIG. 5(*b*) is a top plan view of a container illustrating the scoring of the container shown in FIG. 5(*a*).

FIG. 5(*c*) is a cross sectional side view of a single material layer which has been scored prior to attachment of the reclosable pour spout of the present invention.

FIG. 13(*b*) is a top plan view of a container illustrating the opening formed and shown in FIG. 13(*a*).

DETAILED DESCRIPTION OF THE PREFERRED EMBODIMENTS

Figure 1A:
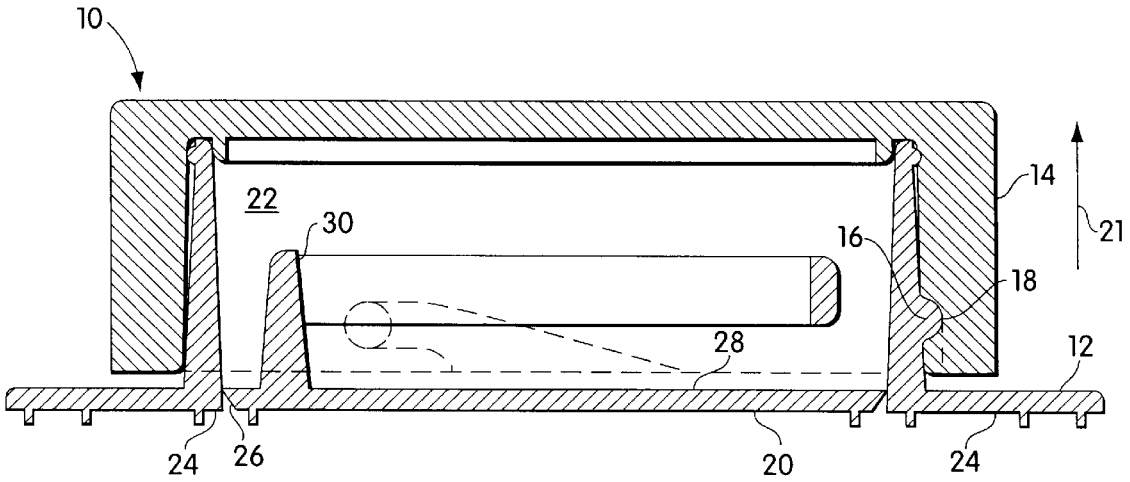
FIG. 1(*a*) is a cross sectional side view of one embodiment of the reclosable pour spout in a membrane seal having a screw off cap.
Figure 1B:
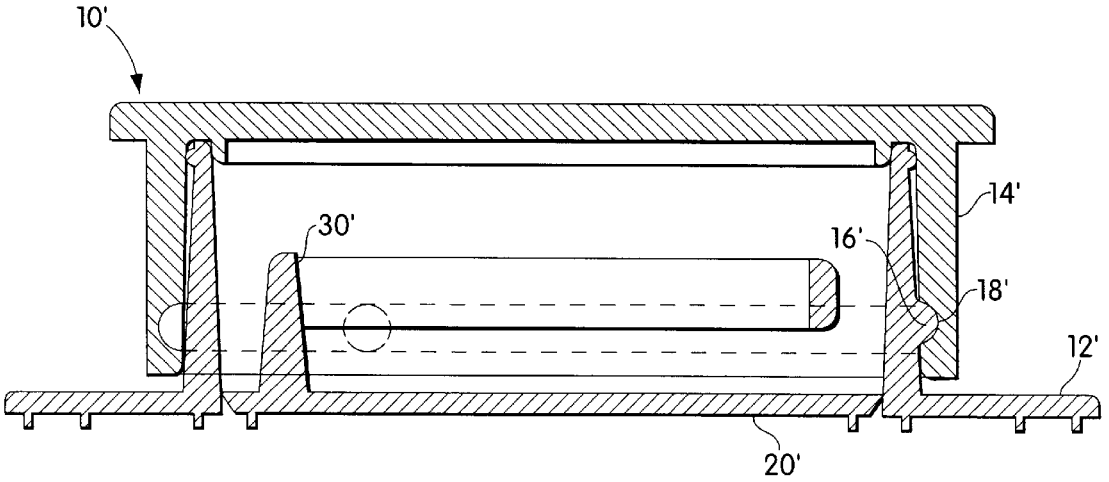

As seen in FIG. 1(*a*), the reclosable pour spout 10, according to the present invention, includes a base member 12 and a cap 14. The cap 14 is attached to the pour spout and base member 12 by a screw thread 16 formed on the base member 12 which interacts with a recess 18 in the cap 14 in a manner well known to those skilled in the art. An inner membrane seal 20 is formed within the inner section 22 of the base member and is approximately and substantially coplanar with the bottom 24 of the base member 12. The inner membrane seal is attached to the inner periphery 24 of the base member 12 along the outer circumference 26 of the seal 20. On the top surface 28 of the inner membrane seal 20 is attached a pull device 30 which may be a ring or tab or handle or any other protrusion suitable for grasping by the user.

The joint between the inner circumference 24 and the member 26 is frangible such that the material bonding members 24 and 26 may be broken by either pulling up (up being defined as the direction of arrow 21) so that the inner membrane seal may be pulled out of the spout, after, of course, the cap 14 has been previously screwed off. Base member 12 and the inner membrane seal 20 may be molded together to form a unitary unit whereas the cap 14 may be separately molded and placed on the base member 12 the closed position as shown in FIG. 1(*a*).

FIG. 1(*b*) is similar to FIG. 1(*a*) with the exception that instead of a screw type member to hold the cap 14' to the base 12', a protrusion 16' is formed in the base unit 12 and a corresponding annular ring 18' is formed in the inside of the cap 14'. Thus, in FIG. 1(*b*), rather than the cap 14' being screwed off the base member 12' for removal, it is snapped off. In the closed position shown in FIG. 1(*b*), the protrusion 16' cooperates with the annular detent 18' to hold the cap on to the base member 12. As in FIG. 1(*a*), a inner membrane seal 20' is formed integrally with the base member 12' and like the membrane seal 20 of FIG. 1(*a*) may be removed from the inside of the spout by either pulling the tab 30' upwardly or pushing it downwardly (in a direction opposite to arrow 21) to produce an aperture which was previously occupied by the inner membrane seal 20'.

Figure 2:
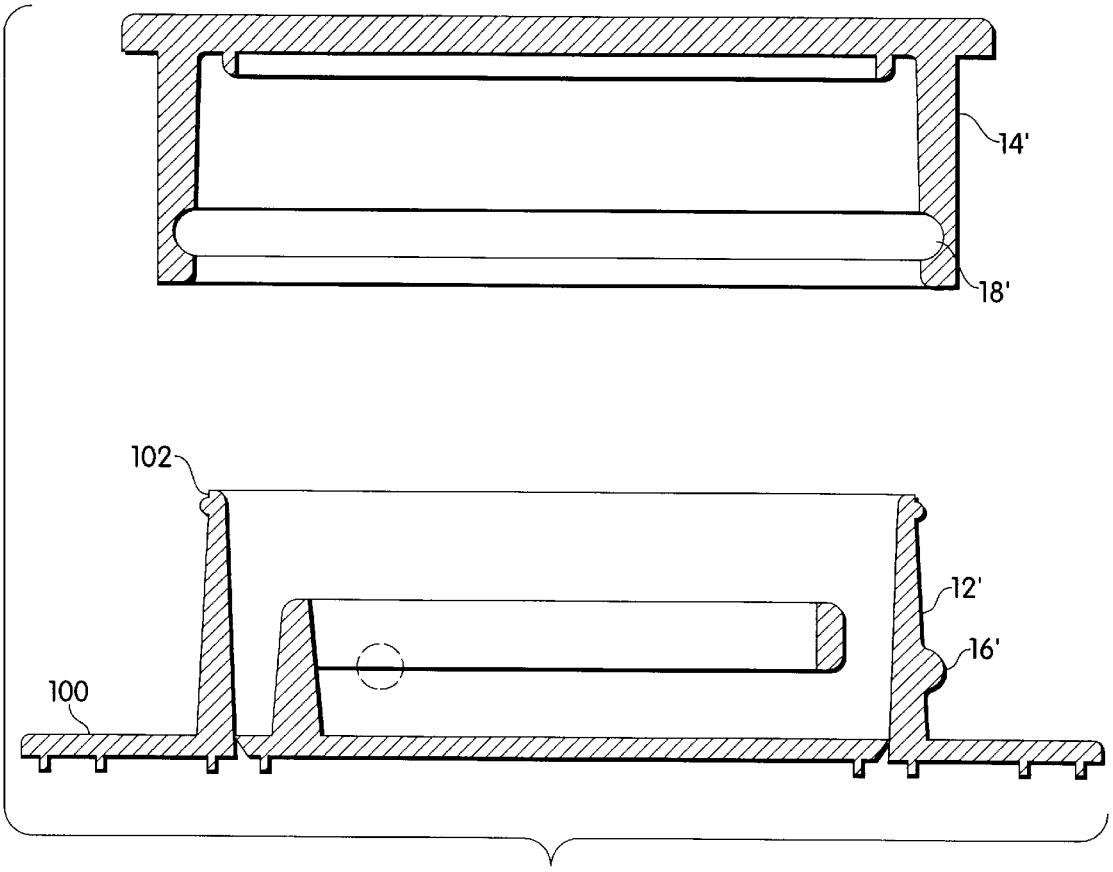
FIG. 2 is another cross sectional but exploded side view of the embodiment of FIG. 1(*b*) having a snap-type cap for the pouring spout.
Figure 3:
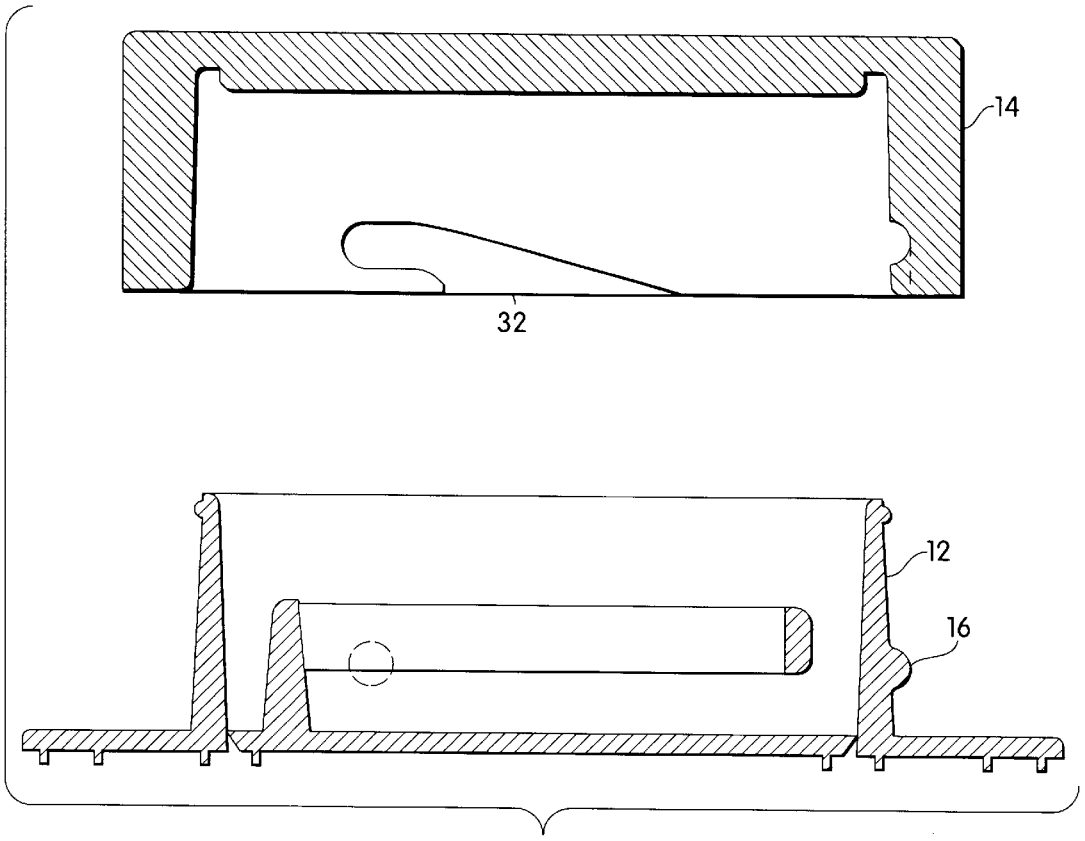
FIG. 3 is another cross sectional but exploded side view of the pour spout and cap of FIG. 1(*a*).

FIG. 2 illustrates a pour spout of FIG. 1(*b*) and illustrates the disengagement of the cap 14' from the base member 12'. The annular recess 18' and the annular protrusion 16' are seen in their exploded configuration. Similarly, in FIG. 3, the cap 14 illustrated in FIG. 1(*a*) is shown in exploded view with respect to the base member 12. The protrusion 16 cooperates with the inner recess 32 to hold the cap onto the base member 12.

Figure 4:
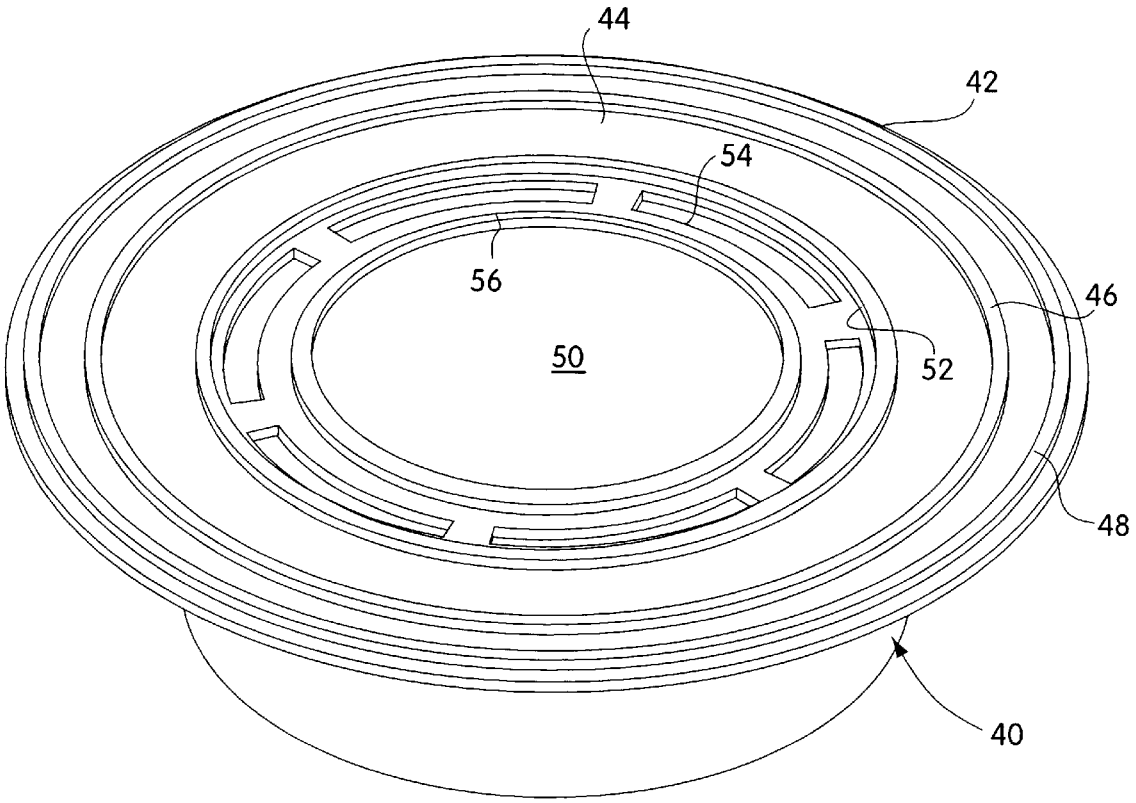
FIG. 4 is a bottom perspective view of the reclosable pour spout with inner membrane seal.

FIG. 4 illustrates a bottom perspective view of the pour spouts in both FIGS. 1(*a*) and 1(*b*). As shown in FIG. 4, a base member 40 includes a flat annular disk portion 42, whose surface 44, when assembled on a container, is in contact with the container. Annular upstanding rings 46 and 48 may be included to provide a better seal with the container but may be eliminated, as desired. The bottom surface of an inner membrane seal 50 is shown attached to the inner annular portion 52 54 by spidering joints disposed around the circumference 56 of the inner membrane ring. These spidering attachments, well known to those skilled in the art, provide a frangible connection of the inner membrane seal to the inner circumference 56 of the base member 42 but it is a connection not so firm as to not be disengageable. Upon applying pressure to the inner membrane seal either by pulling or pushing the inner membrane seal in the direction of arrow 21 of FIG. 1(*a*), the inner membrane seal will break away because of the spidering 54 from the base member 42, as will be explained in further detail below.

Figure 5A:
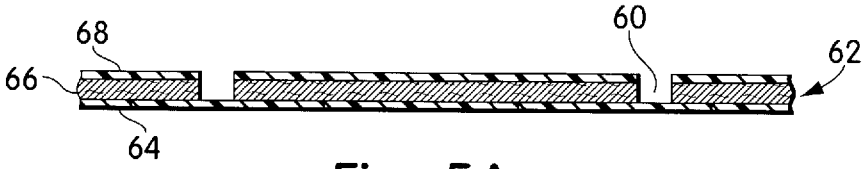
FIG. 5(*a*) is a cross sectional side view of a multilayer container which has been scored prior to attachment of the reclosable pour spout with inner membrane seal of the present invention.
Figure 5B:
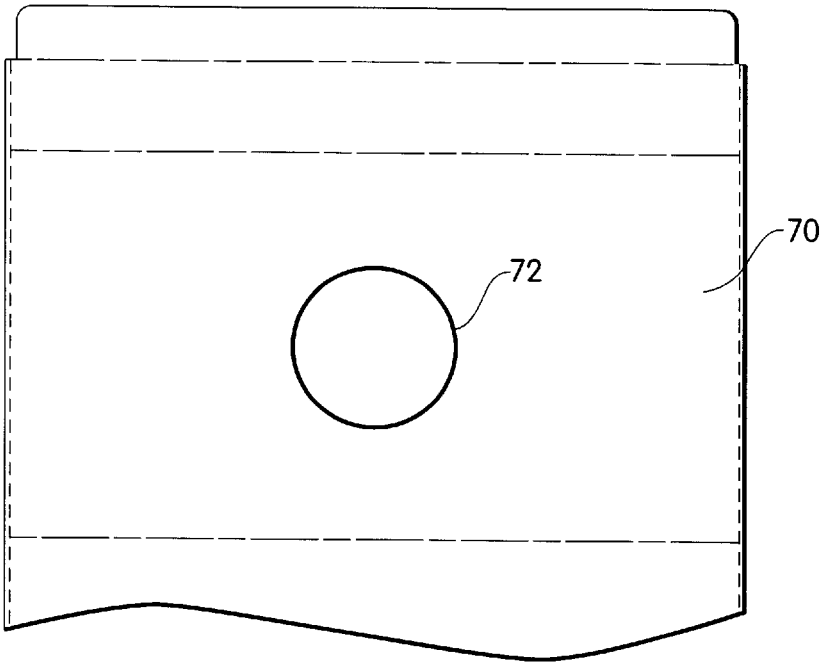
Figure 5C:
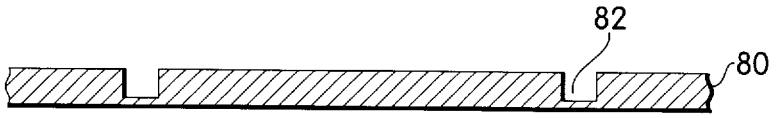

While the improved pour spout may be attached directly to a surface of a container in order to facilitate the opening of the container, the container may be provided with scoring 60 as illustrated in FIG. 5(*a*). The container, a small portion of which is shown in side view in FIG. 5*a* as portion 62, includes an inner liner layer 64, and a central cellulose or other material layer 66 bonded to it. Bonded also to the cellulose or intermediate layer is an outer liner layer 68 which is also attached to the inner layer 66. As shown in FIG. 5*a*, the container has been scored through both the outer liner layer and the intermediate layer, leaving only the inner liner layer structurally unscored or partially scored.

FIG. 5(*b*) illustrates on a container surface 70 a circular scoring 72 of the type shown in FIG. 5(*a*) in a circular manner. Of course, if desired, the shape of the scoring may be of a different configuration, i.e., square, rectangular or triangular as may be desired by those skilled in the art.

FIG. 5(*c*) illustrates scoring of a container material which may be of a uniform, noncomposite layer material. As shown in FIG. 5(*c*), a container of a given material 80 has been scored with scoring 82 through a thickness of the material. The depth of the scoring will depend on the strength of the material and upon the desired amount of force required to remove the material within the area of the scoring 82. It is to be understood, of course, that in assembling the pour spout to the container 70, as shown in FIG. 5(*b*), the diameter of the scored section may be equal to or less than the diameter of the inner membrane seal to which it is attached.

For purposes of illustration, the base member 12', as shown in FIG. 2, may have a height that is a distance from the surface 100 to the opening 102 of any desired height as may be suitable for the particular liquid contained within the container to which the reclosable pour spout is to be attached. The inner membrane seal may have a diameter of any desired proportion and may be approximately 1.5 inches in diameter. The base member 12' and cap 14', also shown in FIG. 2, may be made of any material, preferably polyethylene or other similar plastic material. While the reclosable pour spouts shown in FIGS. 1(*a*) and 1(*b*) differ in the method of fastening of the cap to the base member, they are of overall similar dimensions so that they may each be applied to a container by the same type of applicator mechanism. The amount of force required will depend upon a number of factors including the diameter of the membrane seal, the degree to which the membrane seal is attached to the base member and the strength of the container material to which the inner membrane seal will be attached.

Figure 6:
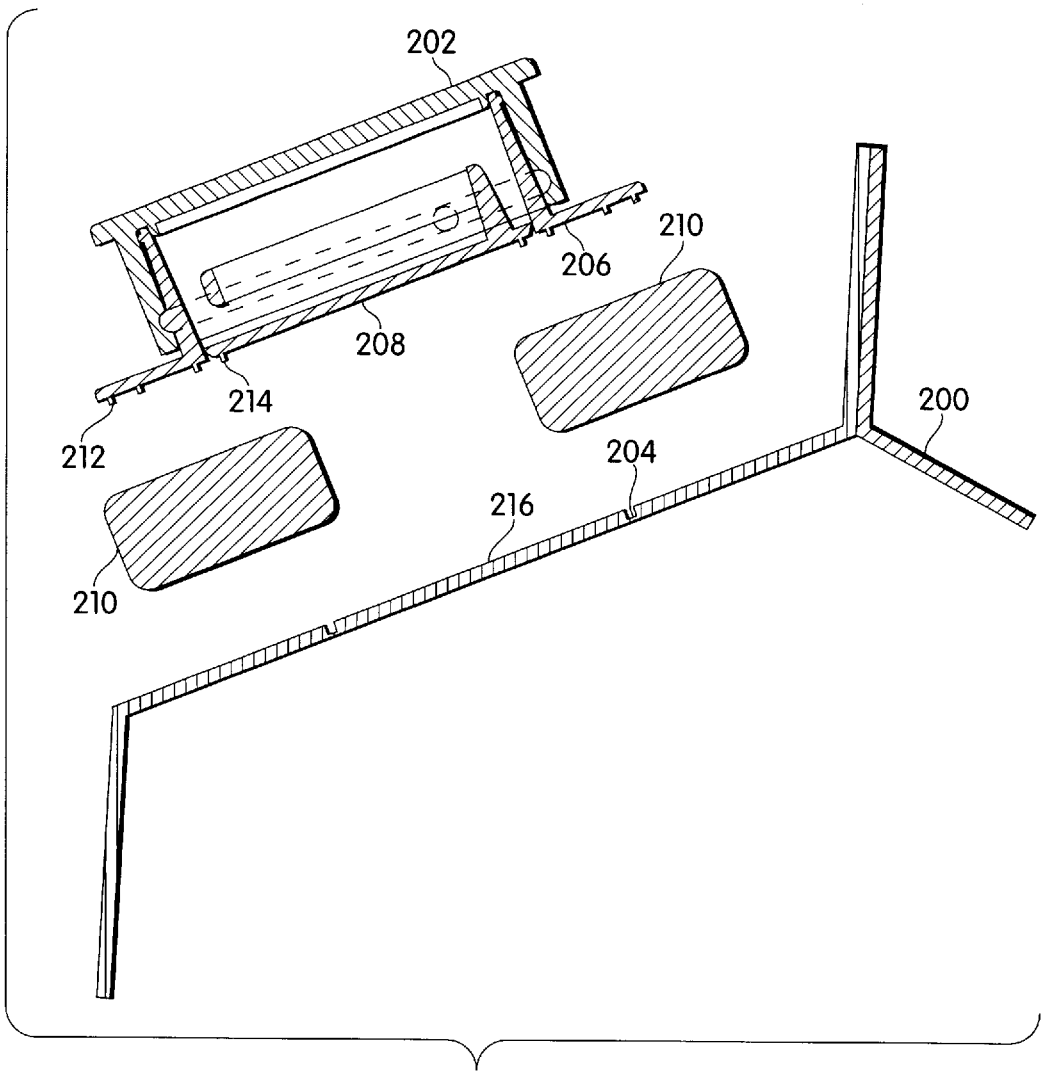
FIG. 6 is a side view, particularly a cross section, showing the reclosable pour spout with inner membrane seal before it is attached to a container but having applied thereto means to attach the spout to the container.

FIG. 6 illustrates a container 200 to which a pourable reclosable pour spout with inner membrane seal 208 is to be attached. The container may be coated with a polyethylene material and has already been scored with scoring 204. The score 204 is centered at the location to which the reclosable pour spout is to be applied. The depth of the score may be chosen such that the force necessary to tear and remove the circular "slug" formed within the scored area of the container is less than the container's delamination force. The diameter of the score, which may be circular, may be smaller than the diameter of the opening of the reclosable pour spout.

Figure 7:
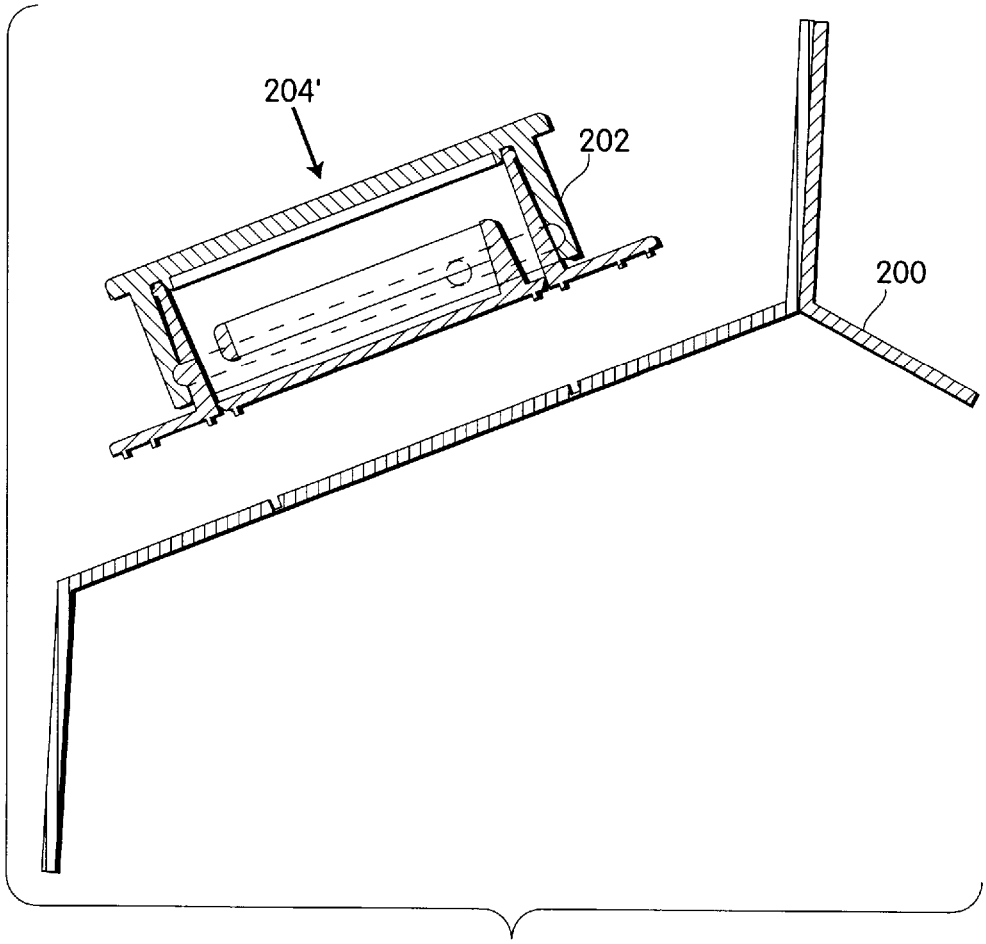
FIG. 7 is a side view of the spout just prior to attachment to the container.
Figure 8:
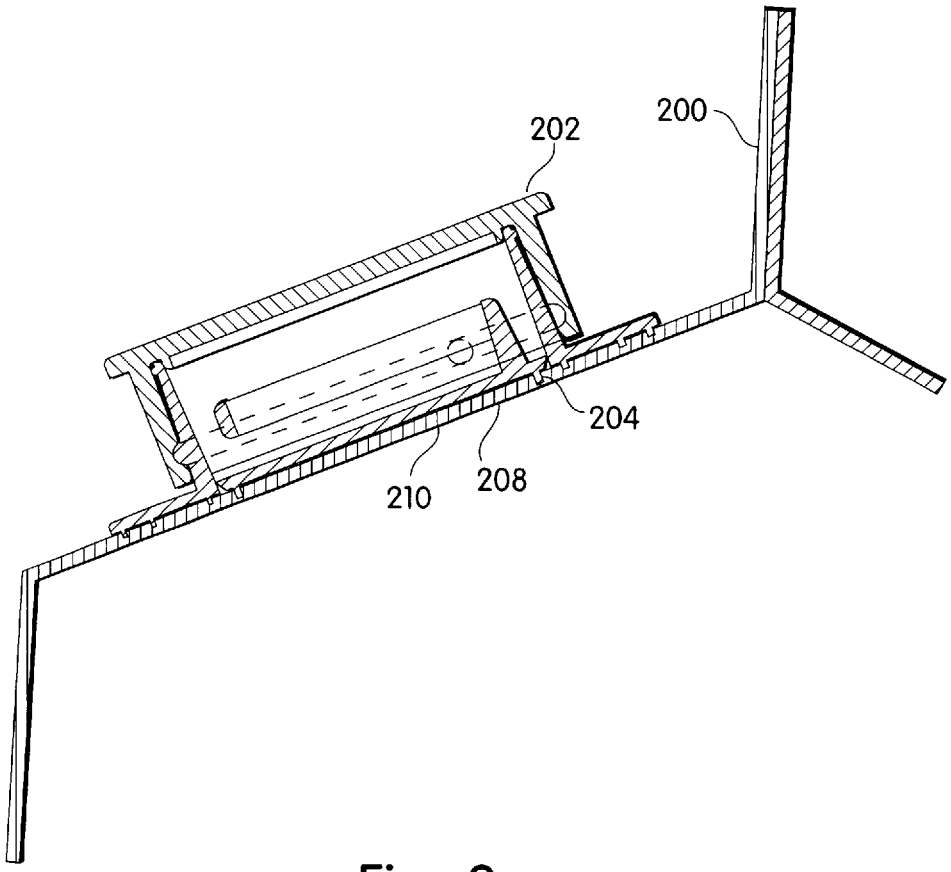
FIG. 8 is a side view of the reclosable pour spout assembled on to the container.

FIGS. 6, 7 and 8 illustrate the method of attaching the reclosable pour spout with inner membrane seal to the container 200 by a combination of heat and pressure, or a combination of hot melt adhesive and pressure or hot melt adhesive alone. In the embodiment shown in FIG. 6, the reclosable pour spout may be attached either prior to filling or after filling and sealing of the container 200. It is imperative that the method of attachment of the seal to the container not compromise the container's intended protective integrity.

For purposes of illustration, the container 200 is shown in FIG. 6 as being formed of a single layer but may also be formed by multiple layers as illustrated in FIG. 5(*a*). In the attaching the reclosable pour spout to the container 200, the bottom surface 206 of the spout, including the portion 208 forming the bottom surface of the inner membrane seal, is heated to a near molten or molten state by means of heaters 210 shown schematically in FIG. 6. The raised rings 212 and 214 on the spout will also be heated to the near molten or molten state prior to application to the container. The surface 216 of the container is preferably clean and dry for better adhesion of the reclosable pour spout 202. The surface 216 may also be heated to a near molten or molten state prior to application of the reclosable pour spout.

Figure 15:
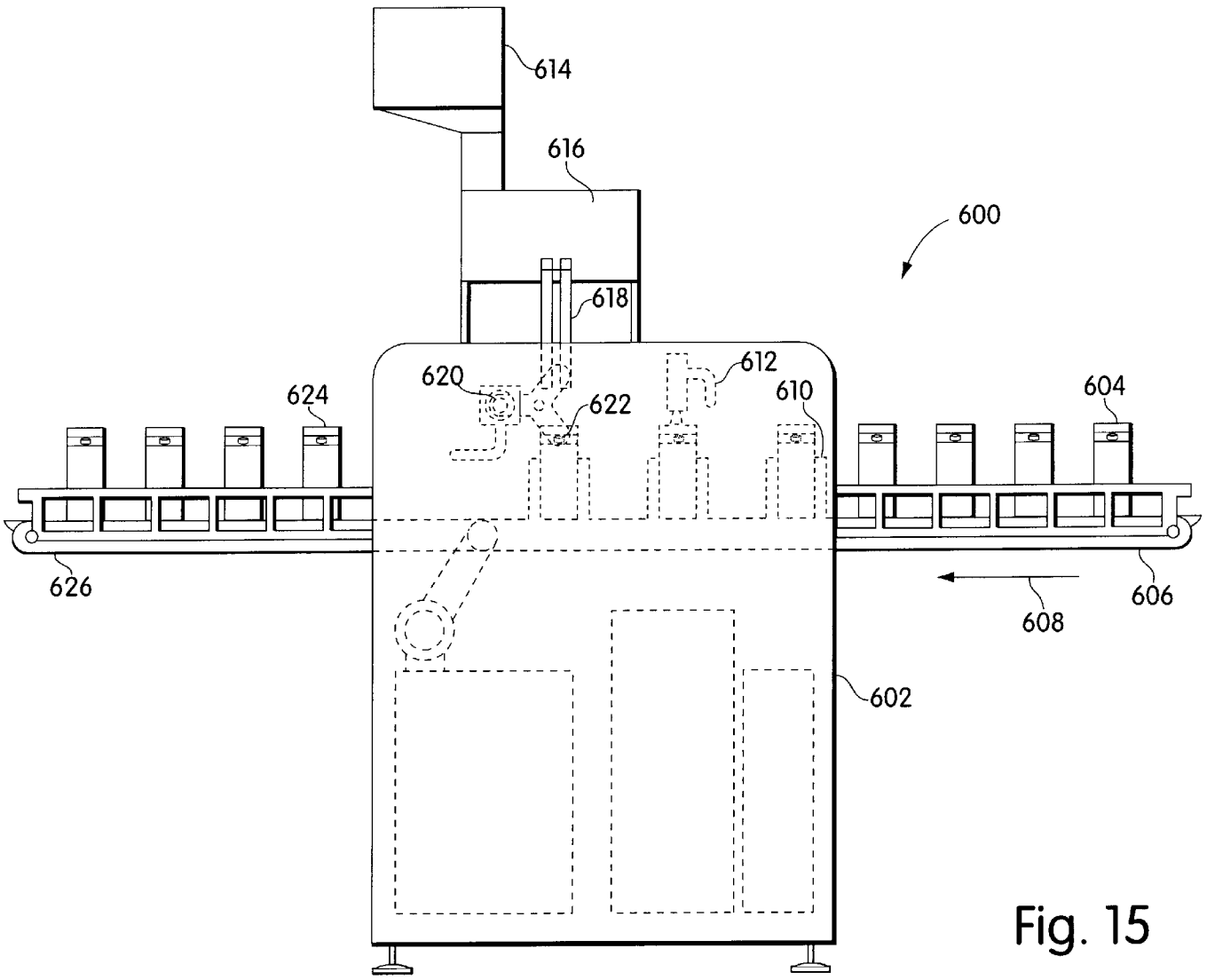
FIG. 15 illustrates an apparatus which may be used to attach the reclosable pour spout on containers.

In FIG. 7, after either or both of the reclosable pour spout 202 and the container 200 have been suitably heated and are applied in direction shown by arrow 204, by a suitable applicator, described in connection with FIG. 15 are brought together while the heated material on the pour spout and on the container are still in a near molten or molten state. This melting of the materials together provides the bond between the reclosable pour spout and the container.

The final assembly position of the reclosable pour spout on to the container is illustrated in FIG. 8 whereby the reclosable pour spout has been assembled and bonded on to and with the container. As shown in FIG. 8, the inner membrane 208 overlies the area of the container formed by the scoring 204. In order to strengthen the bond between the slug 210 of the container, formed by the scoring 204, to the inner membrane seal 208, additional adhesive such as hot melt glue may be applied to either the slug or to the bottom of the inner membrane seal (or to both) prior to assembly. This will insure that when the inner membrane seal is moved that the bond between the inner membrane seal and the slug will be strong enough to prevent them from coming or tearing apart. Alternatively, the heating of the container and the reclosable pour spout may be dispensed with and suitable glue or other adhesive may be used to hold the reclosable pour spout 202 on to the container 200.

Figure 9:
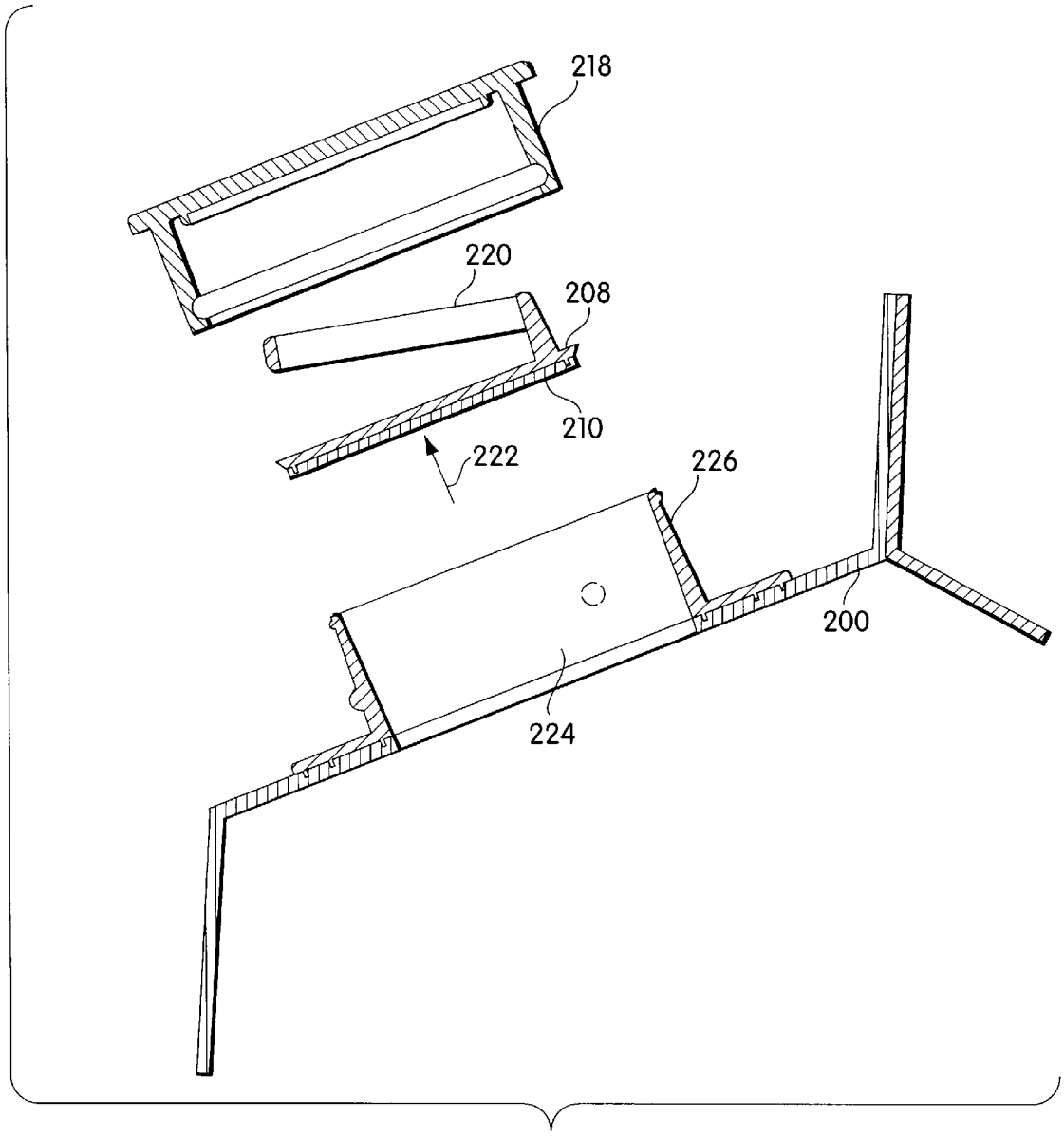
FIG. 9 is a side view of the pour spout with inner membrane seal and cap removed.

FIG. 9 shows an exploded view of the container with the attached reclosable pour spout in the condition in which the inner membrane has been removed. Prior to removing the inner membrane seal, the cap 218 is either snapped or screwed off in a manner as described with respective FIGS. 1(*a*), 1(*b*), 2 and 3, and the tab 220 of the inner membrane seal 208 pulled in a upward direction as illustrated by the arrow 222. As can be seen in FIG. 9, by pulling upwardly on tab 220 both the inner membrane seal 208 and the slug 210 formed by the scored portion of the container 200 is removed, thus, allowing free flow of fluids through the opening 214 formed by the spout portion 226. The inner membrane seal may then be discarded and, if desired, the cap 218 resealed on the spout 226.

Figure 14:
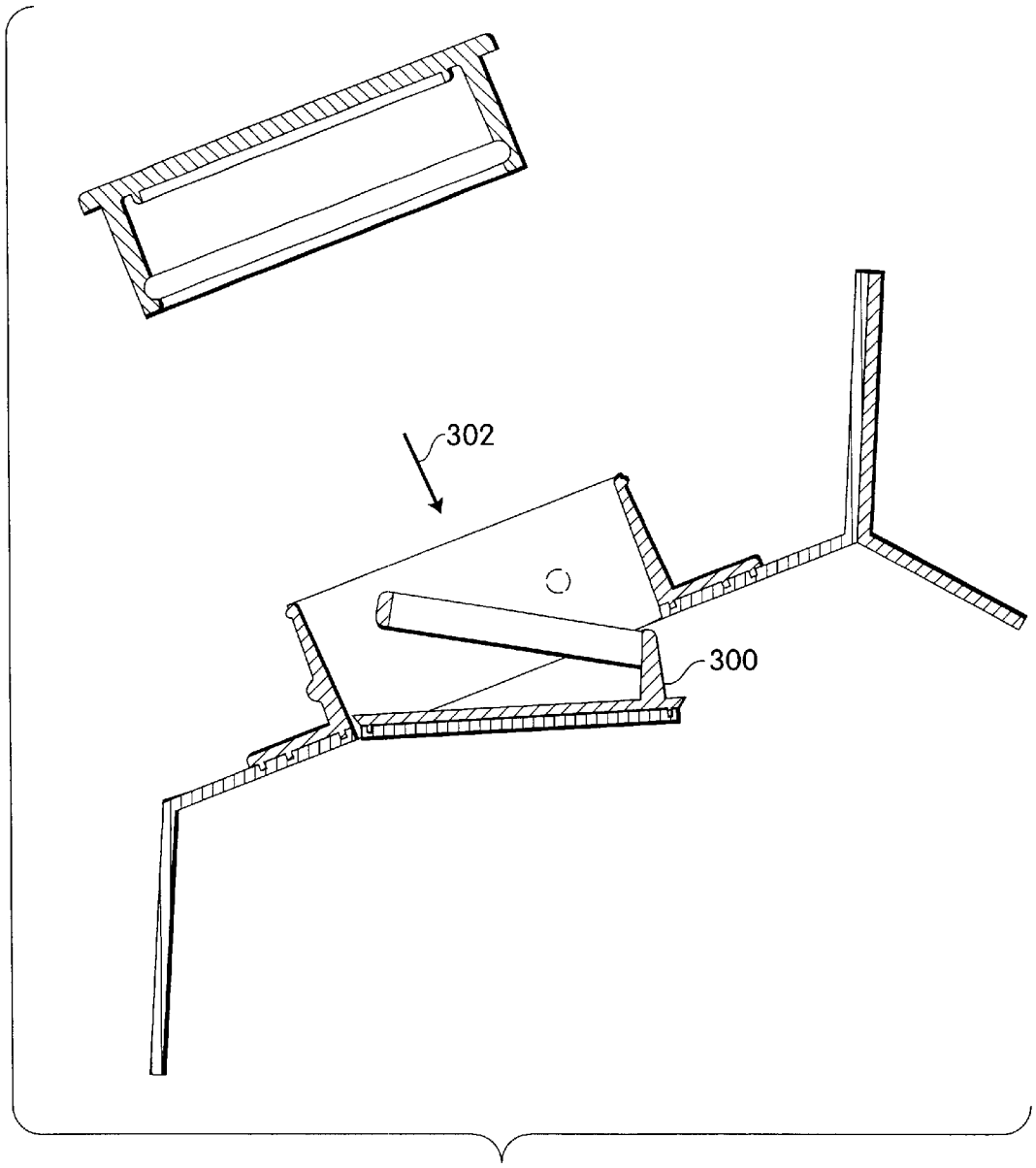
FIG. 14 illustrates the removal of the inner membrane seal by pushing through rather pulling the inner membrane seal as illustrated in FIG. 9.

FIG. 14 is similar to FIG. 9 except that in FIG. 14 instead of pulling upwardly in a direction 222 shown in FIG. 9, the inner membrane seal with slug attached 300 is pushed downwardly shown by arrow 302 into the container. This downward movement may then push the slug with the membrane seal attached into the container, or may be used only to break the score of the container and then be pulled outwardly, as shown in FIG. 9.

Figure 10:
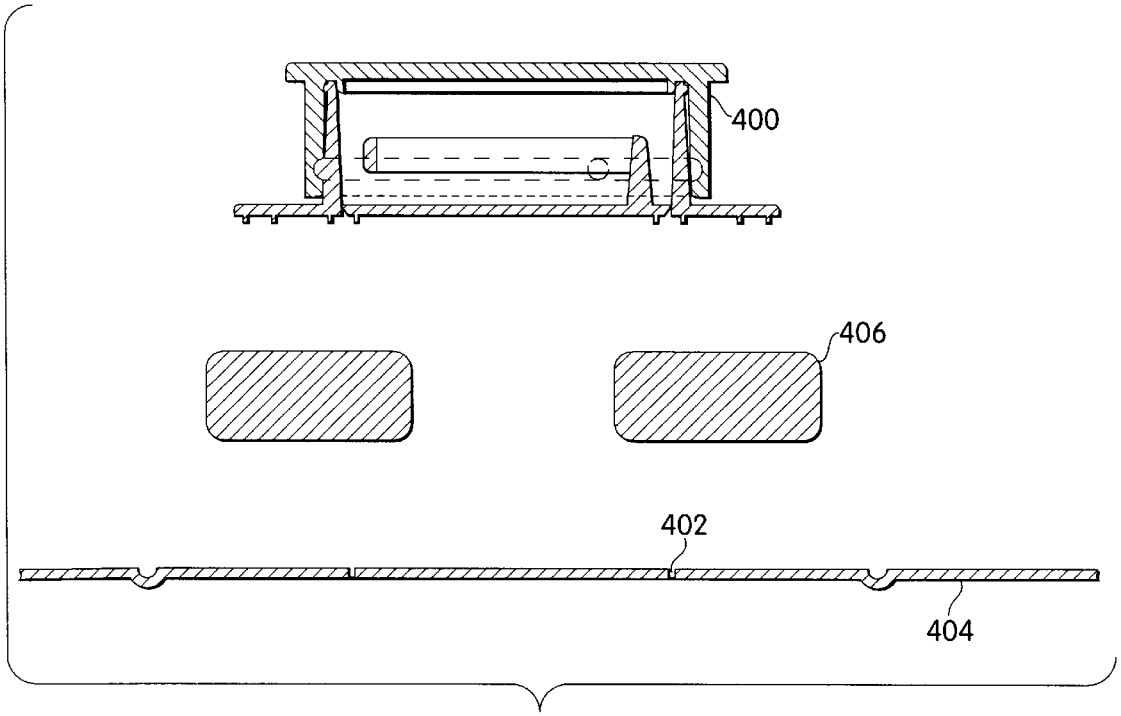
FIGS. 10, 11 and 12 illustrate the attachment of the reclosable pour spout with inner membrane seal on a container which has yet to be formed and filled.
Figure 11:
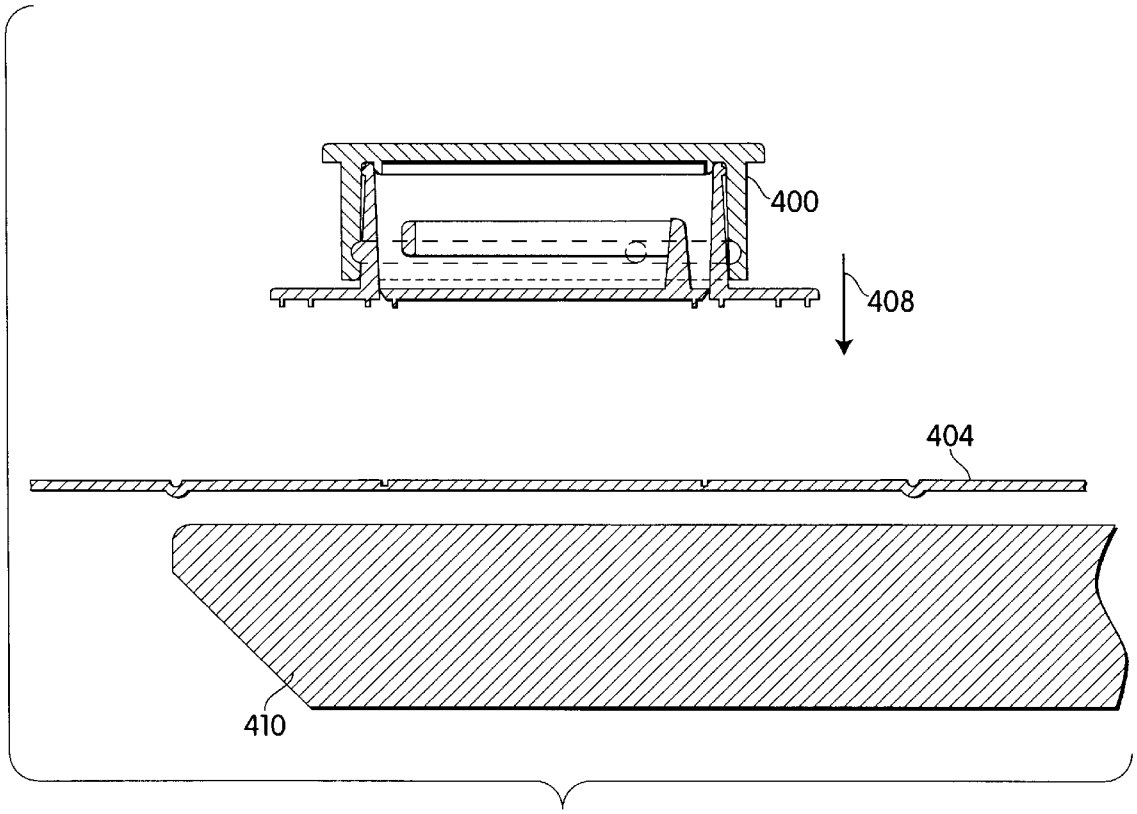
Figure 12:
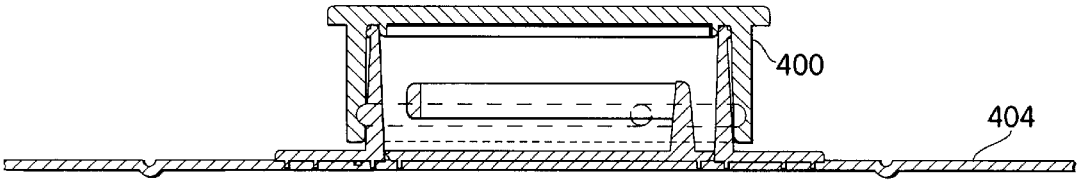

FIG. 10 shows the method of attachment of a reclosable pour spout with a cap 400 to a container 404 which has been scored with scoring 402 but has not yet been folded and filled with desired liquid. As described above in connection with FIG. 6, the container 404 and the spout 400 are to be heated to near molten or molten temperature by heaters well known in the art illustrated schematically as 406. The method of attachment of the reclosable spout 400 to the container 404 in FIGS. 10, 11 and 12 may be used when the liquid contained within the container cannot tolerate the high temperatures and pressure induced on the container in the process described with respect to FIGS. 6, 7 and 8. As shown in FIG. 10, both the spout and the container are heated to a near molten or molten temperature. In FIG. 11, the spout 400 is lowered in the direction 408 shown by the arrow to come into contact with the container 404. However, in this method, a bar or support 410 is positioned below the surface of the container 404 to give back up support to that portion of the container to which the pouring spout is to be attached, as shown in FIG. 12.

Figure 13A:
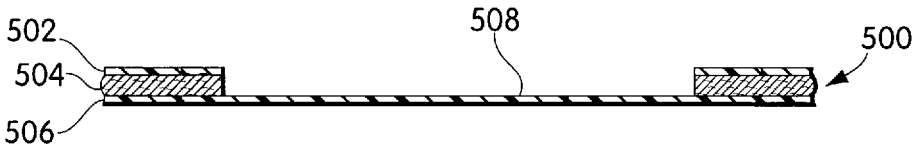
FIG. 13(*a*) is a cross sectional side view of a container whose outer layers have been removed.
Figure 13B:
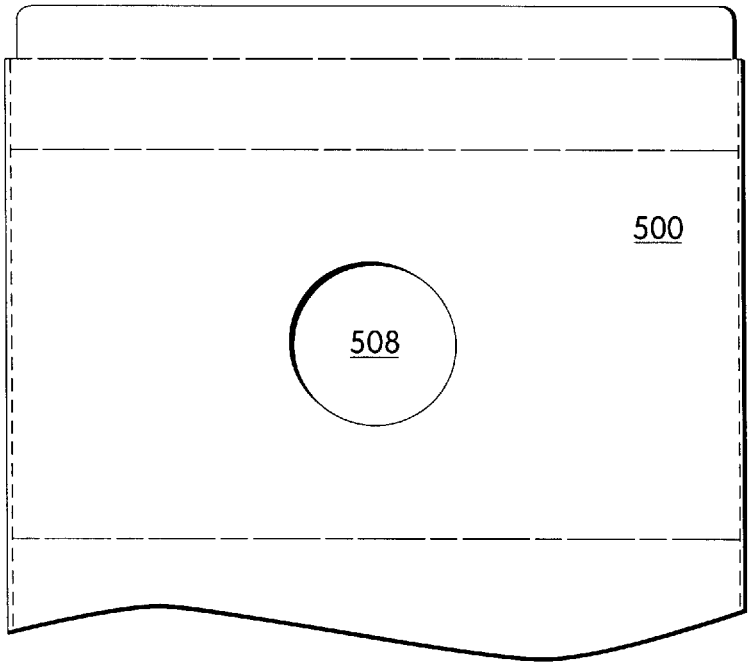

FIG. 13(*a*) illustrates a multilayer container in which all but the innermost or container inner liner layer has been removed. The container portion 500 has a number of layers 502, 504 and 506, the innermost layer being in contact with the liquid in the container. The liner is made of a metal foil or polyethylene or other plastic. As illustrated in FIG. 13(*a*), the removal of layers 502 and 504 leaves open an inner exposed section 508. The retention of only the innermost layer has the benefit of maintaining integrity of the packaging while allowing the inner membrane seal to be attached directly to the thin section 508. This will allow the membrane seal, upon being either pulled up away from the container or pushed into the container, to only have to carry away with it only one layer. The embodiment of FIG. 13(*a*) also eliminates the possibility of delamination which is possible in the embodiment of FIG. 6. In the FIG. 6 embodiment, a user, upon pulling the membrane seal in an outwardly direction, could pull only the upper most layer of the container away with the seal leaving one or more inner layers and requiring further efforts in order to open the container for removal of the fluid. The manner of attachment of the reclosable pour spout with attached inner membrane seal to the container shown in FIGS. 13(*a*) and 13(*b*) is the same as that shown in FIGS. 6 through 8, except that it may be preferable to utilize a hot melt adhesive at least in the bottom surface of the inner membrane seal so that the inner membrane seal attaches firmly to the portion 508 of the container shown in FIG. 13(*b*). After the reclosable pour spout has been attached to the container 500 of FIGS. 13(*a*) and 13(*b*), a pull tab may be either pulled up out of the spout or pushed into the container so that the inner membrane seal will be removed from the reclosable pour spout with the slug 508 attached.

FIG. 15 illustrates an apparatus 600 which may be employed to apply the reclosable pour spout of the present invention on to containers. Machine housing 602 contains the various electric motors and controls, well known in the art, to perform the assembly of the reclosable pour spouts on to containers. A number of containers 604 travel on machine conveyer 606 in the direction of arrow 608. In this example, containers are formed, filled and sealed prior to being placed on the machine in-feed conveyor 606. Formed, filled and sealed containers may have been previously scored, in accordance with the teachings of the present application, prior to being placed on the machine conveyor 606. The containers are, upon entering the machine housing 602, first placed in a container staging area 610 which orients and positions the containers for the subsequent steps to be discussed. After having been properly positioned in the container staging area 610, containers proceed along the conveyor to a container top cleaning and drying station 612. The portion of the containers which are to receive the reclosable pour spout of the present invention is cleaned and dried to provide good adhesion of the spouts to the containers. Reclosable spouts are contained in the closure hopper 614 and proceed to a closure singulator orientator station where individual spouts are oriented for placement on containers. Single spouts are then delivered to a "spout delivery station" 618 and then to a closure heating or glueing station, as explained in the discussion above, and finally to a spout-to-container application station 622. As described above, the spouts may either be glued or heated, alone or in conjunction with the container, prior to the application of the reclosable pour spout of the present invention to a container. Container 624 coming out of the machine housing now has the reclosable pour spout of the present invention attached to it. The container with the spout attached then proceeds along the machine outfeed conveyor 626 to be removed from the conveyor or to proceed to the next preparation station.

The principles, preferred embodiments and modes of operation of the present invention have been described in the foregoing specification but the invention that is intended to be protected herein should not be construed as limited to the particular forms disclosed and should be regarded as illustrative rather than restrictive. Variations and changes can be made by others and equivalents employed without departing from the present invention. Accordingly, the foregoing detailed description should be considered exemplary in nature as expressly intended that all such variations, changes and equivalents which fall within the scope of the present invention as set forth in the attached claims be embraced thereby.

What is claimed is:

1. A reclosable pour spout which may be secured to an exterior surface of a container body comprising:

a base member having oppositely positioned first and second sides, and a aperture extending therethrough, the second side of the base member being the side which may be secured to the exterior surface of the container;

an extension connected to and extending axially away from the first side of the base member, the extension having an aperture formed and extending therethrough which intersects with and corresponds to the aperture in the base member; and a membrane seal with opposed surfaces mounted within the extension positioned in the vicinity of the intersection of the extension and the second side of the base member, one surface of the membrane seal being positioned approximately in the plane of the second side of the base member wherein the one surface of the membrane seal and the second side of the base member may each be attached to the exterior surface of the container body, the membrane seal having a periphery which is smaller than the aperture in the base member and is attached around its periphery to the base member by a frangible connection so that the membrane seal may be detached from the reclosable pour seal.

2. The reclosable pour spout of claim 1, in which the base member and the extension are formed of a molded plastic material, the frangible connection and the membrane seal also being formed with the base member and the extension of the molded plastic material.

3. The reclosable pour spout of claim 1, wherein the frangible connection comprises spidering on the periphery of the membrane.

4. The reclosable pour spout of claim 1, in which the extension has an outer surface and comprises at least one annular ring in the outer surface, the reclosable pour spout further comprising a cap with an outer and interior surface, the cap having an annular recess in the interior surface which cooperates with the annular ring in the outer surface of the extension to close the aperture formed in the extension.

5. The reclosable pour spout of claim 1, in which the extension has an outer surface and comprises at least one annular threaded screw formed in the outer surface, the reclosable pour spout further comprising a cap with an outer and interior surface, the cap having an annular threaded recess in the interior surface which cooperates with the annular ring in the outer surface of the extension to close the aperture formed in the extension.

6. The reclosable pour spout of claim 1, further comprising at least one annular raised ring extending from the second surface of the flange.

7. The reclosable pour spout of claim 1 further comprising a means mounted on the surface of the membrane seal within the extension for facilitating removal of the membrane seal.

8. The reclosable pour spout of claim 7, in which the means may be pulled to break the frangible connection between the membrane seal and the pour spout and remove the membrane out through the aperture in the extension.

9. The reclosable pour spout of claim 8, in which the means may be pushed to break the frangible connection between the membrane seal and the pour spout and push the membrane seal out through the aperture in the flange.

10. A container for holding and dispensing pourable material having a container body having an exterior surface, an interior surface, the distance between the exterior surface and the interior surface defining the thickness of the container body, the container also having an interior for receiving pourable material;

a reclosable pour spout secured to the exterior surface of the container, the reclosable pour spout comprising:

a base member having oppositely positioned firs and second sides, and a aperture extending therethrough, the second side of the base member being the side which may be secured to the surface of the container;

an extension connected to and extending axially away from the first side of the base member, the extension having an aperture formed and extending therethrough which intersects with and corresponds to the aperture in the base member;

a membrane seal positioned in the vicinity of the intersection of the extension and the second side of the base member, the membrane seal having a periphery which is smaller than the aperture in the base member, the membrane seal being attached to the base member around its periphery by a frangible connection so that the membrane seal may be detached from the reclosable pour seal, the membrane seal being of a thickness less than the extent of the extension and having first and second opposed surfaces, the first surface being on the side of first side of the base member, the second side being approximately in the plane of the second side of the base member; and, the second surface of the base member and the second side of the membrane seal each being attached to the exterior surface of the container, whereby when the frangible connection is broken, the membrane seal may be removed from the pour spout through the aperture formed in the extension.

11. The container of claim 10, wherein the removal of the membrane seal does not disrupt the attachment of the base member from the container.

12. The container of claim 10, wherein the second side of the membrane seal, upon removal, pulls out with it the portion of the container which is attached to the membrane seal.

13. The container of claim 10, wherein the means for attachment of the second surface of the base member and the second side of the membrane seal to the exterior surface of the container comprises a pressurize heat seal.

14. The container of claim 10, wherein the means for attachment of the second surface of the base member and the second side of the membrane seal to the exterior surface of the container comprises a pressurize heat seal and an adhesive.

15. The container of claim 10, wherein the means for attachment of the second surface of the base member and the second side of the membrane seal to the exterior surface of the container comprises an adhesive.

16. The container of claim 15, wherein the adhesive is a hot melt glue.

17. The container of claim 10, wherein the reclosable pour spout is attached to the container prior to the container receiving pourable materials in the interior thereof.

18. The container of claim 10, wherein the reclosable pour spout is attached to the container after the container receives pourable materials in the interior thereof.

19. The container of claim 10, further comprising a scoring formed on at least one of the exterior surface or the interior surface of the container and extending a distance through the thickness of the container body, the scoring enclosing an area of a defined shape.

20. The container of claim 19, wherein the reclosable pour spout is attached to the exterior surface of the container such that the second side of the membrane seal is in the vicinity of the area defined by the scoring to facilitate removal of the portion of the container defined by the scored area with the removal of the membrane seal from the spout.

21. The container of claim 18, wherein the container comprises an inner liner layer forming the interior surface of the container, at least one intermediate layer with an inner and outer side, the inner side being attached to the inner liner layer on the surface of the inner liner layer opposite to the layer defining the interior surface, and an outer liner layer attached to the outer side of the intermediate layer, the outer liner layer having an outer surface forming the exterior surface of the container.

22. The container of claim 21, wherein the scoring penetrates the exterior surface of the container a distance through the outer liner layer and the intermediate layer.

23. The container of claim 21, wherein the scoring penetrates the interior surface of the container a distance through the inner liner layer and the intermediate layer.

24. The container of claim 19, wherein the container comprises a uniform material forming the interior and exterior surfaces and the distance between the interior and exterior surfaces, and wherein the scoring penetrates the uniform material approximately between 10 percent and 80 percent of the thickness of the uniform material.

25. The container of claim 21, wherein the outer liner and intermediate layers are removed from the area defined by the scoring.

26. The container of claim 21, wherein the reclosable pour spout is attached to the exterior surface of the container such that the second side of the membrane seal is attached to the container in the vicinity of the area defined by the scoring to facilitate removal of the inner liner layer with the removal of the membrane seal from the spout, thus allowing access to the contents of the container.

27. The container of claim 26, wherein the removal of the membrane seal comprises removal through pulling the membrane seal through the aperture formed by the extension.

28. The container of claim 26, wherein the removal of the membrane seal comprises removal through pushing the membrane seal through and into the interior of the container.

29. The container of claim 26, wherein the removal of the membrane seal comprises removal through first pushing the membrane seal through the scoring and removal through the aperture formed by the extension.

30. A method of assembling a reclosable pour spout onto a container body for holding and dispensing pourable material, the container body having an exterior surface, an interior surface, the distance between the exterior surface and the interior surface defining the thickness of the container body, the container also having an interior for receiving pourable material;

the reclosable pour spout having a base member with oppositely positioned first and second sides, and a aperture extending therethrough, the second side of the base member being the side which may be secured to the surface of the container;

an extension connected to and extending axially away from the first side of the base member, the extension having an aperture formed and extending therethrough which intersects with and corresponds to the aperture in the base member;

a membrane seal positioned in the vicinity of the intersection of the extension and the second side of the base member, the membrane seal having a periphery which is smaller than the aperture in the base member, the membrane being attached around its periphery to the base member by a frangible connection so that the membrane seal may be detached from the reclosable pour seal, the membrane seal being of a thickness less than the extent of the extension and having first and second opposed surfaces, the first surface being on the side of first side of the base member, the second side being approximately in the plane of the second side of the base member;

the method comprising: heating at least one of the second side of the base member and the membrane seal and the exterior container surface to which the reclosable pouring spout is to be attached to at least a near molten condition;

positioning the reclosable pouring spout in the vicinity of the portion of the exterior of the container to which it will be attached;

contacting the second sides of the base member and the membrane seal to the exterior surface of the container, the second surface of the base member and the second side of the membrane seal each thereby being attached to the exterior surface of the container;

whereby when the frangible connection is broken, the membrane seal may be removed from the pour spout through the aperture formed in the extension.

* * * * *